United States Patent [19]

Latimer et al.

[11] 4,319,414

[45] Mar. 16, 1982

[54] DREDGEHEAD HAVING FORWARD WATER-DEFLECTING MEANS COMPRISING TWO TRANSVERSE ELEMENTS

[75] Inventors: John P. Latimer, Newport News; Charles Garland, Williamsburg, both of Va.

[73] Assignee: Deepsea Ventures, Inc., Gloucester Point, Va.

[21] Appl. No.: 155,315

[22] Filed: Jun. 2, 1980

[51] Int. Cl.[3] ..... E02F 3/92

[52] U.S. Cl. ..... 37/58; 37/DIG. 8

[58] Field of Search ..... 37/54, 55, 57, 58, 64–67, 37/72, DIG. 8

[56] References Cited

U.S. PATENT DOCUMENTS

| | | | |
|---|---|---|---|
| B 531,753 | 3/1976 | Brockett | 37/DIG. 8 |
| 1,070,271 | 8/1913 | Lybeck | 37/55 |
| 3,171,219 | 3/1965 | Kaufmann et al. | 37/67 X |
| 3,253,357 | 5/1966 | Allard | 37/65 |
| 4,171,581 | 10/1979 | Donaldson et al. | 37/DIG. 8 |

*Primary Examiner*—Clifford D. Crowder

*Attorney, Agent, or Firm*—Barry G. Magidoff

[57] ABSTRACT

Apparatus to direct the flow of water passing towards and alongside of a dredgehead (of the type, for example, utilized to obtain valuable mineral ores from the ocean depths) in a downwardly direction, so as to utilize the force of the water to assist the dredgehead in loosening and removing any particulate ore nodules from the ocean floor. The flow-directing means includes two transverse elements, one extending substantially longitudinally along the length of the dredgehead and the second transversely connecting the vertical element to the dredgehead.

7 Claims, 4 Drawing Figures

DREDGEHEAD HAVING FORWARD WATER-DEFLECTING MEANS COMPRISING TWO TRANSVERSE ELEMENTS

This invention relates to means for providing the deflection of water in front of a dredge head, especially of the type useful for the recovery of ocean floor nodule ores.

With the recognition of the limited supplies of raw materials, and especially metals, from previously available terrestrial mine sites, a great deal of effort has been put into the development of means to mine valuable metal ores from the abyssal depths of the oceans. Such means have generally centered about the utilization of extremely deep water dredging means, especially at depths of between 10,000 and 18,000 feet, to bring up what is known as ocean floor nodule ore, or manganese nodules.

The extreme conditions met at such great ocean depths, particularly in the way of pressures, have necessitated the development of a new generation of dredging equipment. Generally, a dredging means is connected to a surface vessel by way of a device for bringing the ore from the ocean floor to the surface. The dredging head can be, for example, of the suction nozzle variety, wherein the ore is literally sucked into a nozzle, much in the way of a vacuum cleaner, and then transferred to the vertical means rising to the surface. Such vertical means, generally utilized in combination with a suction head nozzle, include hydraulic means for lifting the ore suspensed in, generally, water. Mechanical means for the removal of such ocean floor ores have also been utilized, including, for example, continuous bucket chains or digging scoops.

Generally, the dredging means, of whatever type, are pulled through the water utilizing, for example, the length of pipe for hydraulically lifting the ore from the floor to the surface vessel. The dredging means, and particularly the suction nozzle head, is thus subject not only to the pressures at the abyssal depths but also to the problems of hydrodynamic drag created by the continuing flow of water as it is moved along the ocean floor, by towing, as well as problems of solid obstacles on the generally not well charted ocean floor.

Because of the inability of man to survive and work at these great depths, even by utilizing the newest experimental techniques, the operation of such dredges has necessarily entailed telemetric controls. Such long distance operations of a device has, of course, decreased the efficiency of collection of the operation; but such inefficiency has been, of necessity, accepted as part of the risks of any such venture. In an attempt to improve the recovery rate, for example, of the suction head nozzle type devices, mechanical means have been employed, such as by way of fingers or probes, thrusting ahead of the nozzle opening to loosen the nodule particles from the ocean floor. Although this has been at least partially successful, there has also been a great deal of loss caused by these particles being swept away along the side of the nozzle as it is being pulled through the water.

Deposits of valuable metal ores are found lying on the surface of the soft sea floor as nodules, or as generally fist-sized "rocks" which are only partially immersed within the sediment on the ocean floor. The nodule materials, of course, vary greatly in size, from what can be considered relatively small pebbles or even grains, up to relatively large rocks, or even boulders. Granite and other stone boulders are of course also often encountered when passing along the deep ocean floor.

The general concept of directing the hydraulic flow is shown in U.S. Pat. No. 4,171,581, entitled "Water-Flow Deflecting Shield for Dredge Suction Nozzle".

It is accordingly an object of the present invention to provide means to improve the effectiveness of such water-flow deflecting element.

In accordance with the present invention, there is provided a dredging vehicle adapted to be moved in a forward direction through a body of water, dredging means supported by the vehicle, preferably of the suction type, and having a dredge inlet adjacent the bottom of the vehicle, and facing in at least a partially forwardly direction, and water-deflecting means supported on the vehicle forwardly of the dredge means and designed to deflect water flowing from the front towards the rear of the vehicle downwardly towards the dredging inlet, the water-flow deflecting means including a leading element, extending along the height of the dredging means, and a transverse flow-directing element connecting the leading element to the lower portion of the dredging means. In a preferred embodiment, the dredging means comprises a suction nozzle having a nozzle inlet located adjacent the bottom of the nozzle and the forward portion of the nozzle inlet being adjacent to the transverse element. The nozzle inlet is further preferably facing in a generally forwardly, and partially obliquely downwardly, direction. Even more preferably, the transverse flow element is pivotally connected to each of the dredging means and the leading element.

In a most useful preferred embodiment of this invention, the dredging means, specifically the suction-type nozzle means, and the water flow-deflecting means, are each pivotally supported at an upper portion of each, from the dredge vehicle. To maintain an optimum angular relationship between the water flow-deflecting surface of the leading element and the nozzle inlet, the pivotal connections between the flow-deflecting element and the chassis, and the dredging means and the chassis, and the pivotal connections between the transverse flow-deflecting element and the dredging means and the leading element, respectively, provide a so-called parallelogram construction, whereby the opposite sides remain parallel regardless of the angle formed between the dredging means and the horizontal plane.

In a most preferred embodiment, a suction-type nozzle presents an elongated surface facing forwardly towards the free-stream of water and is pivotally connected to the vehicle. The longitudinal water flow-deflecting means is also in turn pivotally connected to the vehicle. Each pivotable connection rotates about a substantially horizontal axis, extending transversely, preferably substantially perpendicularly, to the direction of water flow and substantially parallel to the other axis. The pivotable connections between the transverse flow-directing element and the vertical element and the nozzle, respectively, each rotate about a substantially horizontal axis parallel to each other and to the aforesaid two axes of rotation. Similarly, the distance between the latter two axes of rotation, i.e., substantially the length of the transverse flow-directing element, is equal to the distance between the first two axes of rotation, i.e., between the nozzle and the leading element, respectively.

The leading flow-deflecting element is preferably formed having sufficient structural strength so as to act as a physical shield to protect the dredging means, or nozzle, against any solid obstructions that may be encountered as the dredge vehicle moves along the ocean floor. Furthermore, the independently suspended flow-deflecting element serves also to prevent the hydrodynamic drag force of the free-flow stream of water, created by the movement of the dredge vehicle through the water, from raising the nozzle above the level of the sea floor.

A further understanding of the present invention can be obtained by reference to the preferred embodiments set forth in the illustrations of the accompanying drawings. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

Figure 1:
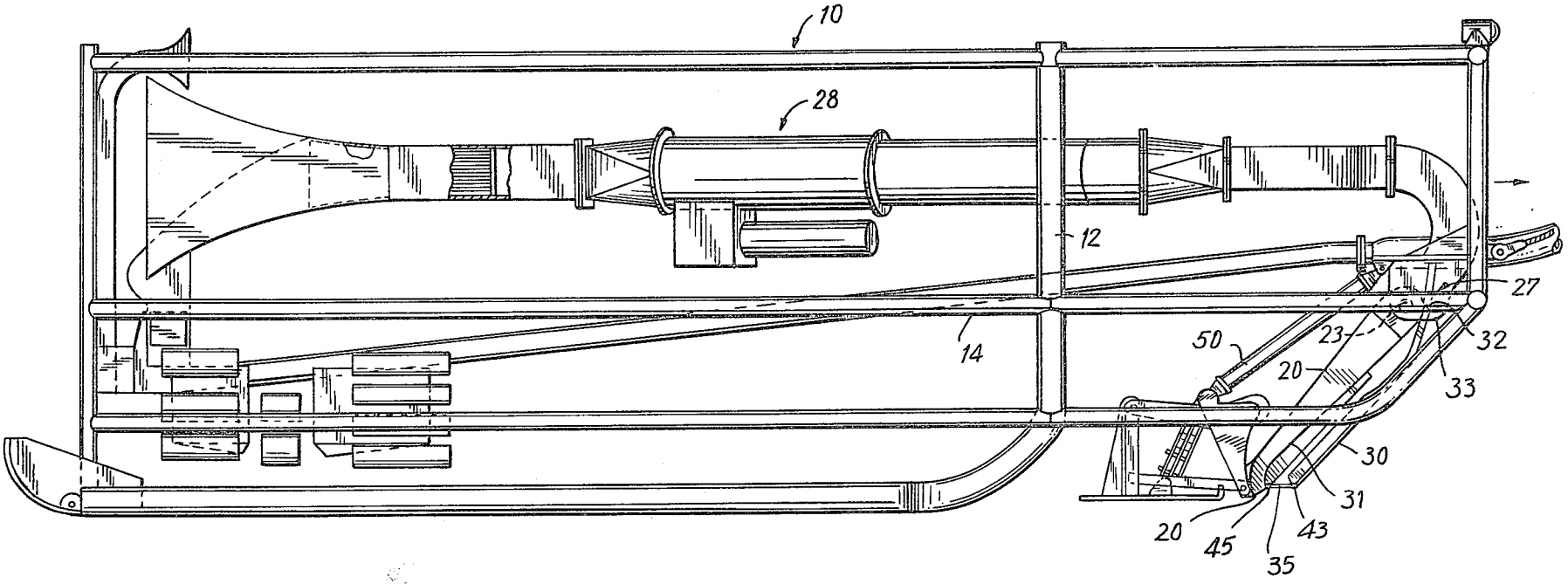
FIG. 1 is a side elevation view of a dredge vehicle including the present invention.
Figure 2:
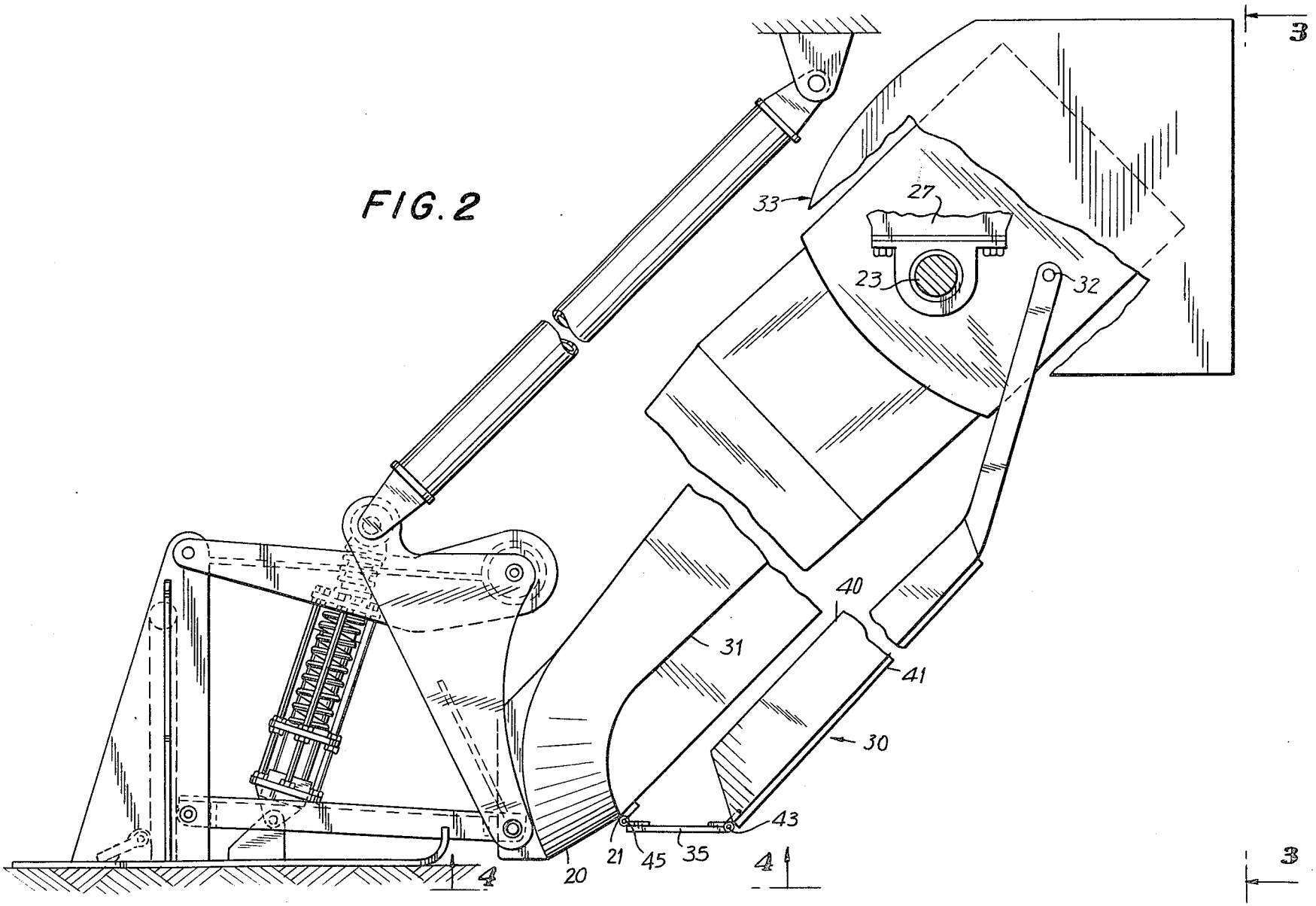
FIG. 2 is a magnified side view showing the portion of the vehicle comprising the present invention.

A dredge vehicle chassis, generally indicated by the numeral 10 is formed of a plurality of intersecting vertical tubular members 12 and horizontal tubular frame members 14. A suction nozzle 20 is pivotably supported from the chassis 10 via a conventional pillow block plate 27 and bearing 23. The nozzle 20 is in turn flexibly connected to water conduit 24, by a conventional seal not shown. Alternatively, the nozzle 20 can be pivotably supported directly by the water conduit 24, the seal between the nozzle and the duct being a part of that supporting joint structure. The water conduit 24 is in turn in fluid-flow connection with a suction pump, indicated generally by the numeral 28.

As shown in this embodiment, the nozzle 20 has a generally obliquely elongated forward surface 31 presented to the free-flow stream of water, moving towards the rear of the vehicle 10 when the dredge vehicle is being pulled through the water during the dredging operation. Interposed immediately forwardly of, and somewhat below the obliquely extending nozzle 20, is a water-flow directing shield 30, pivotally supported at its upper end, via pin 32, on the vertically extending pillow block flanges 33 secured on the two sides of the pillow block 27. The pillow block flanges 33 are rigidly connected to the tubular chassis members of the vehicle 10.

A horizontal flow-directing plate 35 extends transversely between and is pivotally connected, by a pair of axis pins 43, 45, to each of the lower end of the shield 30 and the edge 21 defining the upper end of the nozzle inlet 20, respectively. The horizontal plate 35 extends substantially the full width of the nozzle opening 21, 20 and the shield 30. The length of the horizontal plate 35 between the two axis pins 43, 45 is parallel and of equal length to a line drawn between the shield pin 32 and the nozzle axis 23. In this manner, regardless of the extent to which the nozzle 20 is pivoted rearwardly and upwardly above the level of the ocean floor, the plate 35 remains parallel to the horizontal ground surface, and the shield 30 and nozzle surface 20 maintain the same relationship.

It has been found that although a variety of hydrodynamically streamlined surfaces can be designed for the flow-deflecting shield 30 and the horizontal plate 35, in order to provide the desired downward deflection of the water, with an improved efficiency as regards flow rate measured at the nozzle opening, it has been found that the horizontal plate surface 135 can be a substantially flat surface, as can be the leading surface of the shield 30. Such flat surfaces, at least at the relatively low speeds at which the dredge vehicle is expected to travel, e.g., up to about $2\frac{1}{2}$ knots, provide sufficient efficiency.

Thus, the deflecting shield 30 and the horizontal plate 35 can be formed from thin flat plates 41, 35. The deflecting shield plate 41 has a trapezoidal shape, of decreasing width towards the upper end, and, in the embodiment shown, is stiffened by two vertical ribs 40. Such stiffening is desirable in order to decrease the necessary weight of an inherently rigid plate, which would have to be of substantially greater thickness. The stiffening plates 40 serve to avoid the undesirable flexibility obtained from a lightweight, thin plate. Because of the relatively short length of the horizontal plate 35, i.e., between the pin axes 43, 45, such stiffening ribs are generally unnecessary. Of course, they can be provided if desired.

Figure 3:
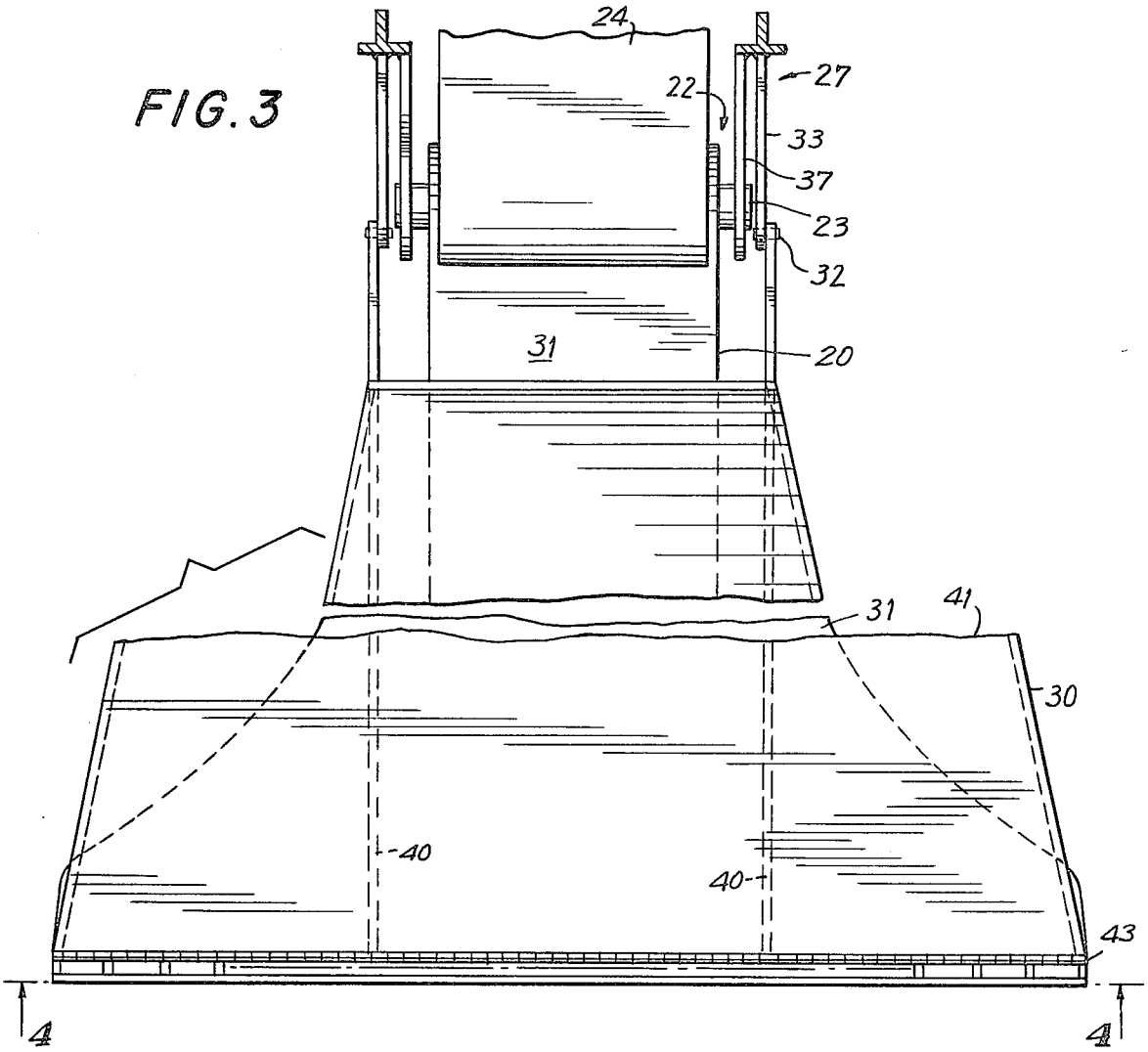
FIG. 3 is a front elevation view of a dredge nozzle and deflecting elements.
Figure 4:
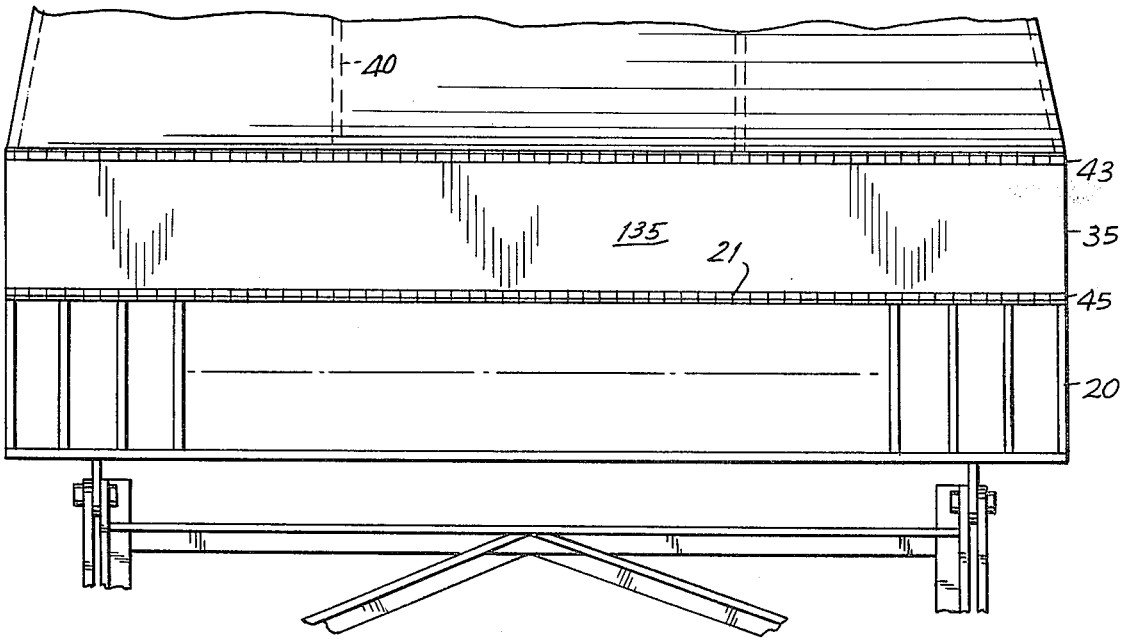
FIG. 4 is a partial bottom view taken along lines 4—4 of FIG. 3.

The upwardly converging shape of the deflecting shield 30, as is shown in the front view of FIG. 3, is dictated by the generally similar configuration of the nozzle 20. As shown, the nozzle 20 is wider at the bottom than at the upper end. The nozzle can be formed of a relatively lightweight, easily formed material, such as rigid PVC plastic material, which is easily molded or otherwise formed to the desired nozzle shape. This permits the use of an extremely simple, and relatively economical, means of forming a nozzle having the most efficient shape from the point of view of hydrodynamic flow. The shield plate 30 is formed of a relatively strong, dense material, such as aluminum metal or steel, and is thus able to absorb any sharp impact, for example from any solid obstructions met with during the travel of the dredge vehicle 10 on the ocean floor. Furthermore, when a relatively large obstruction is met, and the nozzle is pulled upwardly and pivots about the axis 23, the shield moves upwardly in tandem, maintaining substantially the same parallel relationship.

The connecting of the transverse plate 35, between the shield 30 and the nozzle 20 has the surprising effect of increasing the hydrodynamic stability of the nozzle 20 while simultaneously increasing the efficiency of the nozzle in gathering particulate ore from the ocean floor. Quite unexpectedly, the relatively narrow horizontal plate has a significant effect in increasing the velocity, and therefore the effective impact force, of fluid passing along the shield surface of sheet 41 and impinging upon the ocean floor at a location immediately adjacent to and forward of the nozzle opening. This improved streamlining of flow, also serves to reduce the net drag effect on the nozzle, thus reducing the need to weight the nozzle downwardly during forward motion, to maintain the nozzle adjacent the ocean floor.

It has been found preferable that the leading surface of the shield sheet 41 extends at angle of from about 45° to about 60° with the support surface of the vehicle, e.g., the horizontal ocean floor, and most preferably from about 50° to about 55°, when at rest. This angle can be varied by means not shown, for raising or lowering the end of the nozzle 20. The lower surface of the horizontal plate 35 preferably extends parallel to the support surface for the dredge vehicle, e.g., horizontally when on the horizontal ocean floor. This parallel relationship is maintained, by virtue of the parallelogram formed by the elements including the nozzle, flow shield 30 and the transverse plate 35. Alternatively, the lead end 43 of the plate 35 can be raised above the trailing end 45. The line between the pivot pin 32 and nozzle axis 23 should always be substantially parallel to the plate 35.

Although the spacing between the water-deflecting shield 30 and the forward portion of the nozzle opening was considered important absent the presence of the transverse plate 35, the presence of the plate renders such spacing of less importance. However, the flow of fluid should be directed as close as possible to the nozzle, and to that extent the relationship remains important. Accordingly, it is preferred that within the preferred angular relationship to the support surface, the fore-and-aft distance between the shield plate axis pin 43 and the nozzle plate axis pin 45 be in the range of from about 7" to about 12" for a nozzle from about 6 to about 8 feet long. The optimum fore-and-aft dimension of the shield plate 35 can be determined for differing nodule sizes and operating dredge head forward velocity, the nozzle length being less significant.

The dredge vehicle can be any of a variety of devices, including the sled-type vehicle shown in the drawings, a wheeled vehicle, a tracked vehicle, or other means for supporting the dredge head above, or on the surface of, the ocean floor. Any type of vehicle now known or developed in the future, including those which are self-propelled or merely towed, can be utilized. Similarly, any materials can be used for construction of the vehicle, the nozzle or the water-deflecting shield, including any metal or synthetic polymeric plastic material now known or to be developed.

It is further found to be desirable to include a plurality of dredging means, e.g., nozzles, suspended from a single vehicle. As an example, each nozzle is independently pivotally suspended about an axis parallel to the surface upon which the vehicle rides and perpendicular to the intended direction of movement, so as to permit each such nozzle to ride over an undulating or uneven surface independently. Each pivotable nozzle can, therefore, be pivoted above the surface of the sea bottom independently of the other nozzles, whereby the nozzles can more closely follow a surface which undulates in a direction perpendicular to the direction of movement.

As a result of this invention, the drag effect of the flowing water on the nozzle, tending to lift the nozzle off the ocean floor, is reduced while the effect of improving the efficiency of ore particle intake is increased, even while moving at relatively slow speeds on the ocean floor. As a result of this improvement in hydrodynamic flow, the use of weights to hold the nozzle downwardly near the ocean floor is substantially further reduced.

The patentable embodiments of this invention which are claimed are as follows:

1. A dredge vehicle, capable of moving along the floor of a body of water, the vehicle comprising a chassis, a suction-type dredging nozzle body having a substantially vertically elongated surface facing in a forward direction and a nozzle opening at the bottom of such surface facing in a generally forward direction, the nozzle body being pivotably supported from its top upon the chassis, a water flow-deflecting shield pivotally supported from its top upon the chassis at a location forward of and adjacent to the forwardly facing surface of the nozzle, and a transverse plate forming a continuous surface extending along substantially the entire width of the nozzle and between the forward portion of the nozzle body and the lower portion of the shield surface, the plate being pivotally connected to and extending between a forward portion of the nozzle body, adjacent the nozzle opening, and a lower portion of the shield surface, the shield having a forward-facing shield surface which angles downwardly rearwardly from the pivotable support so as to downwardly deflect, towards the nozzle opening, a free-flow stream of water impinging upon the forward shield surface, the shield surface, the nozzle body, the transverse plate, and the chassis, forming a parallelogram of elements, whereby rotating any member serves to rotate the other members about an axis parallel to the support surface and perpendicular to the direction of movement, while maintaining the parallelism of opposite members.

2. The dredge vehicle of claim 1 comprising raising and lowering means for maintaining the shield at a forward rest position and wherein the forward shield surface of the water flow-deflecting shield extends, at rest, at an angle in the range of from about 45° to about 60° to a plane parallel to the chassis members designed to support the dredge vehicle during its forward movement.

3. The dredging means of claim 2 wherein the forward shield surface of the water flow-deflecting means decreases in width in an upwardly direction.

4. The dredge vehicle of claim 1 wherein the nozzle opening faces in a generally forwardly and obliquely downwardly direction.

5. The dredge vehicle of claim 4 wherein the vehicle chassis comprises skid means for traveling over the surface of the ocean floor.

6. The dredge vehicle of claim 4 wherein the water flow-deflecting means extends forwardly of the nozzle and along substantially the entire length thereof, whereby the impingement of water against the front surface of the nozzle as the dredging vehicle moves forwardly through the water is substantially prevented.

7. The combination of claim 1 wherein the flow-deflecting shield and the transverse plate are each substantially rigid members.

* * * * *